United States Patent [19]

Knott

[11] Patent Number: 4,784,081

[45] Date of Patent: Nov. 15, 1988

[54] MIXING DEVICE FOR CROSS-BLENDING OF DEVELOPER MIX IN DEVELOPING STATIONS OF ELECTROPHOTOGRAPHIC PRINTER DEVICES

[75] Inventor: Joseph Knott, Tutzing, Fed. Rep. of Germany

[73] Assignee: Siemens Aktiengesellschaft, Berlin and Munich, Fed. Rep. of Germany

[21] Appl. No.: 943,193

[22] Filed: Dec. 18, 1986

[30] Foreign Application Priority Data

Jan. 17, 1986 [DE] Fed. Rep. of Germany ..... 3601328

[51] Int. Cl.[4] ..... G03G 15/06

[52] U.S. Cl. ..... 118/652; 118/612; 118/657; 118/658; 355/3 DD; 198/537; 198/569; 222/414; 222/564; 222/DIG. 1; 366/131; 366/150; 366/186; 366/309; 366/319

[58] Field of Search ..... 118/612, 652, 657, 658; 355/3 DD; 366/131, 150, 186, 309, 319; 222/414, 564, DIG. 1; 198/525, 537, 569, 671, 860.3

[56] References Cited

U.S. PATENT DOCUMENTS

| | | | |
|---|---|---|---|
| 710,879 | 10/1902 | Mitchell | 198/671 X |
| 1,858,796 | 5/1932 | Wilcoxson | 366/319 |
| 3,115,117 | 12/1963 | Brelsford | 198/671 X |
| 4,026,241 | 5/1977 | Takebe et al. . | |
| 4,145,144 | 3/1979 | Nauta . | |
| 4,146,323 | 3/1979 | Forward et al. . | |
| 4,173,405 | 11/1979 | Swapceinski et al. . | |
| 4,354,763 | 10/1982 | Koiso et al. | 118/612 X |
| 4,361,109 | 11/1982 | Mayer et al. | 118/658 X |
| 4,387,799 | 6/1983 | Sweeney et al. | 198/860.3 X |
| 4,443,102 | 4/1984 | Lux | 118/657 X |
| 4,451,133 | 5/1984 | Kopp et al. . | |
| 4,579,442 | 4/1986 | Minejima | 222/DIG. 1 X |
| 4,634,286 | 1/1987 | Pike | 118/657 X |
| 4,666,283 | 5/1987 | Iida et al. | 355/3 DD |
| 4,700,659 | 10/1987 | Hirakura et al. | 355/3 DD X |

FOREIGN PATENT DOCUMENTS

| | | | |
|---|---|---|---|
| 0092689 | 11/1983 | European Pat. Off. . | |
| 660491 | 3/1934 | Fed. Rep. of Germany . | |
| 1066568 | 10/1959 | Fed. Rep. of Germany . | |
| 2904331 | 6/1980 | Fed. Rep. of Germany . | |
| 3044344 | 6/1981 | Fed. Rep. of Germany . | |
| 56-144465 | 11/1981 | Japan . | |
| 0250370 | 12/1985 | Japan | 355/3 DD |
| 532952 | 3/1973 | Switzerland . | |

*Primary Examiner*—Shrive Beck
*Assistant Examiner*—Alain Bashore
*Attorney, Agent, or Firm*—Hill, Van Santen, Steadman & Simpson

[57] ABSTRACT

In a developing station functioning on the principle of cross-blending in an electrophotographic printing device, two mixing screws running in opposite directions are arranged at a distance from one another. The first mixing screw is situated in a mixing trough provided with a plurality of oblique slots and comprises two mixing strips in the delivery region of the developer mix which are offset by 180° and which neighbor one another. A scraper strip having an actual scraping region and scraping teeth is situated above the two mixing screws. A metering baffle is arranged at an angle relative to this scraper strip, this metering baffle extending through the teeth of the scraper strip and including baffles at its lower end for controlling the flow of the developer mix.

9 Claims, 2 Drawing Sheets

11
20
13
23
26
EF
28
29
27
21
EF
EF
17
14
15
17
22
10
12

MIXING DEVICE FOR CROSS-BLENDING OF DEVELOPER MIX IN DEVELOPING STATIONS OF ELECTROPHOTOGRAPHIC PRINTER DEVICES

BACKGROUND OF THE INVENTION

1. Field of the Invention

The invention relates to a mixing device for blending a developer composed of carrier particles and toner including a first and second mixing screw.

2. Description of the Prior Art

Mixing devices of the type described above are generally known and have been successfully employed. German Letters Patent No. 31 17 309 discloses a mixing device for blending a developer composed of carrier particles and toner which is employed in the developing station of a printer functioning in accord with the electrophotographic principle.

Given this mixing device functioning based on the principle of cross-blending, the resupplied toner is added to the developer in the mixing trough over the full length and is supplied to the developing process at one side at the end of the mixing trough. Since the developer mix enriched with the supplied toner has a higher toner concentration than the remaining developer, a non-uniform toner concentration distribution in the developing region derives due to the single-sided feed of the developer enriched with toner, As a consequent thereof, inadmissibly high inking differences over the printed width can occur. This negative effect becomes especially pronounced given weak inking, high printing format load and when printing bar codes.

SUMMARY OF THE INVENTION

An object of the invention is to fashion a mixing device of the type described above such that the developer drum transporting the developer to the charge image carrier is offered a uniformly blended developer mix over its entire width.

By providing mixing strips which extend over a plurality of spirals of the first mixing screw and which are arranged adjacent by 180° in the entry region and axially offset in the mixing trough, a rapid blending of the supplied developer occurs. When transporting the developer away from the entry region, the developer is uniformly supplied to the mixing chamber via a multitude of openings in the mixing trough.

In an advantageous embodiment of the invention, the mixing trough comprises a decreasing trough height in conveying direction of the developer, so that the developer passes over the edge of the mixing trough into the mixing chamber beginning with a prescribed filling degree. An additional mix level control is therewith achieved given different degrees of filling. A constant mixing level both in the mixing trough as well as in the mixing chamber is necessary for a uniform inking over the print-span.

The formation of the scraper strip at the developer drum in the form of a scraping comb which is fashioned with scraping teeth and which extends over nearly the full width of the developer drum makes it possible for developer adhering to the developer drum to be uniformly removed and to be supplied to the mixing trough for renewed blending.

This procedure is further promoted in that a dosing baffle extending over the region of the scraper teeth is arranged at an angle relative to the scraper strip, this metering baffle supplying the developer strip by the scraper teeth to, first, the mixing chamber via the tooth clearances and, second, to the mixing trough via clearances of the scraper strip.

In that the conveying speed of the developer is considerably reduced in the mixing trough in the region of the mixing strips and, further, what is referred to as a buoyancy of the toner is prevented, and adequate blending of the toner can ensue within a short mixing path. As a result of the short mixing path, the developer enriched with toner can be uniformly offered to the developing process over nearly the full width of the developing station.

The metered passage of the enriched developer into the mixing chamber or, respectively, into the supply region fashioned at the floor of the mixing chamber is effected by defined oblique slots in the mixing trough. As a result of the defined width of the slots, a passage of toner lumps which have not yet been blended in is prevented, namely a passage into the supply region.

Baffles are arranged under the scraper strip, these baffles having the job of lending that part of the developer situated on the developing drum which has not yet been scraped off a defined flow direction in the supply region of the mixing chamber. In interaction with the second mixing screw in the supply region of the mixing chamber, thus, a uniform developer distribution and a fast migration of the developer are achieved.

The mix stream controlled via the metering baffle and the baffles fashioned thereat makes it possible to keep the oblique slots in the mixing trough at the sides of the supply region of the mixing chamber free of developers. The developer therewith falls into the supply region of the mixing chamber unimpeded.

In addition to the improvement of the cross-blending, the described device achieves an automatic emptying of mix by means of the stationary scraper strip. The usual pivoting or the provision of an emptying plate is thus eliminated.

BRIEF DESCRIPTION OF THE DRAWINGS

An embodiment of the invention is shown in the drawings and shall be set forth in greater detail below by way of example. Shown are.

DESCRIPTION OF THE PREFERRED EMBODIMENTS

Figure 1:
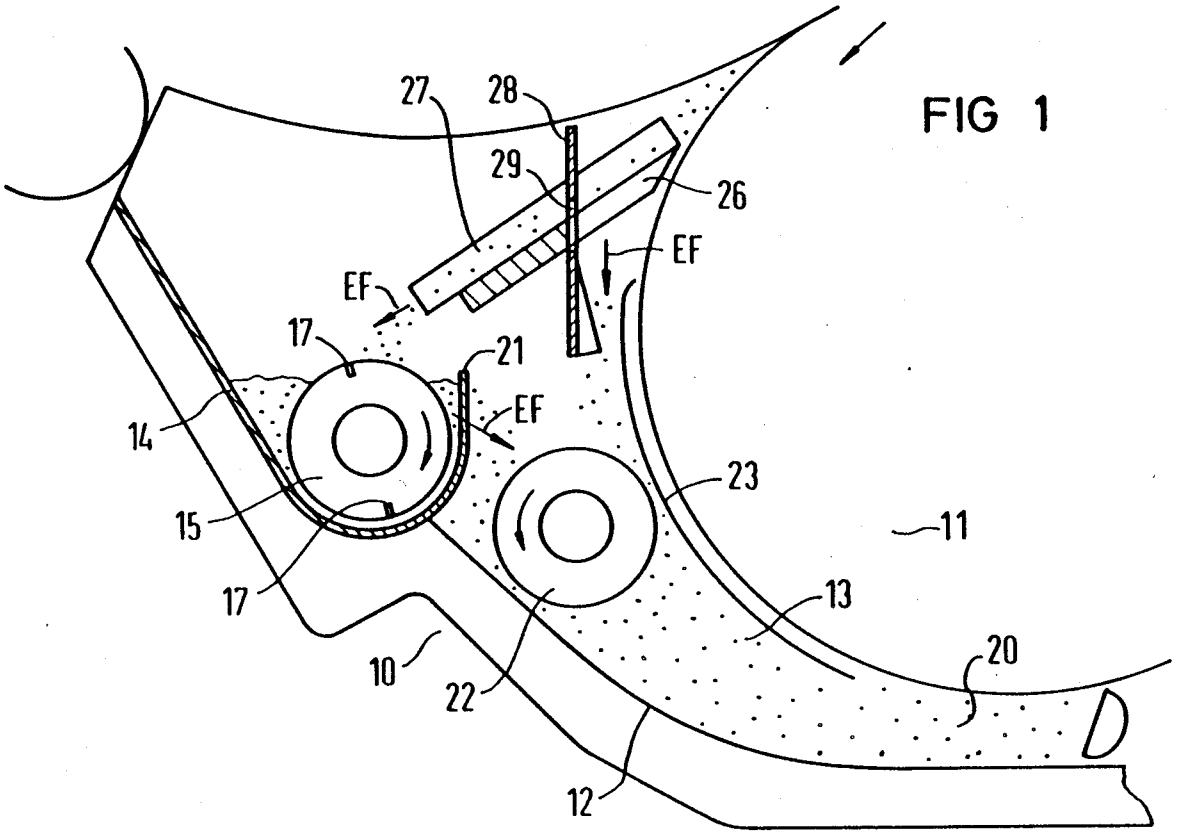
FIG. 1 is a schematic section view of the mixing device.
Figure 2:
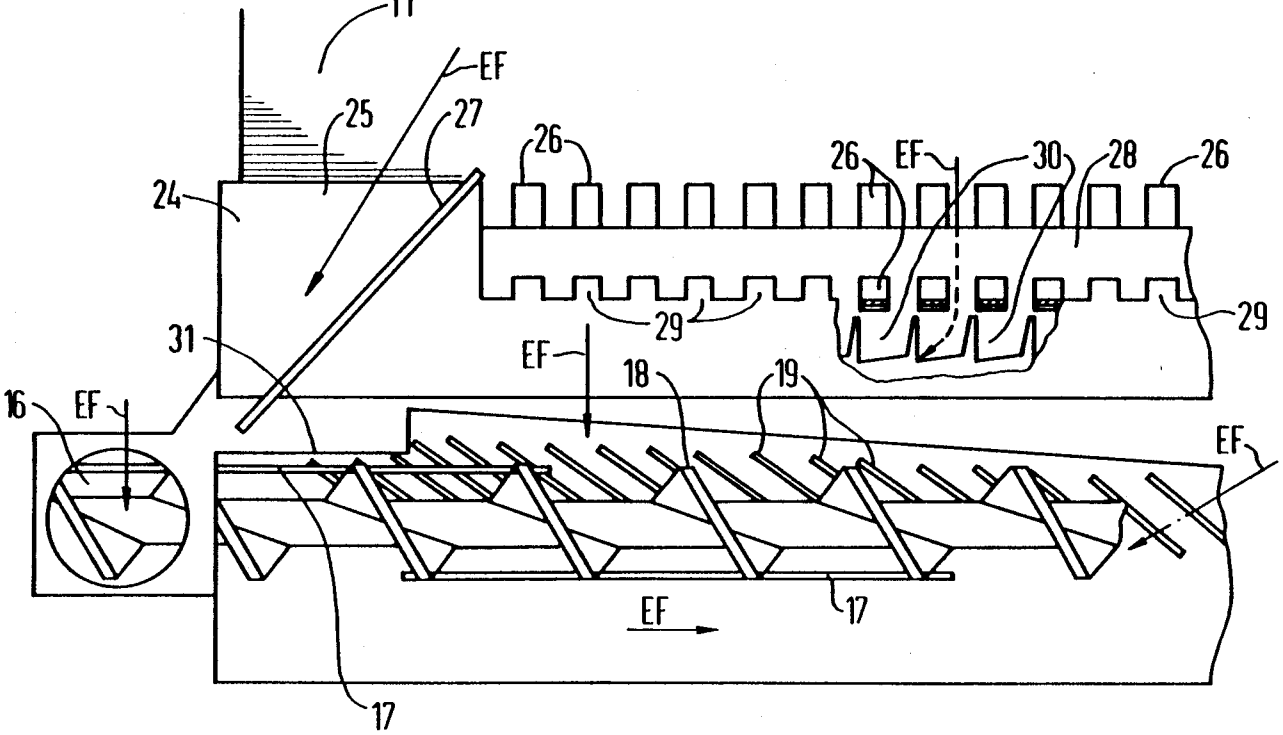
FIG. 2 is a view of the mixing device at an oblique angle from above.

A developing-station 10 working on the principle of cross-blending is arranged in a printer device functioning on the principle of electrophotography which is not shown in detail here. The developing station 10 is situated adjacent to a charge image carrier (not shown here) which is composed of a photoconductive drum and which is inked in a known way via a first developer drum 11 (magnetic brush principle). The developing station 10 contains an actual mixing chamber 12 having a supply region 13 arranged therein and situated at the floor of the developing station and having a mixing trough 14. A first electromotively driven mixing screw 15 is arranged in the mixing trough 14, this first mixing screw 15 comprising two mixing strips 17 offset by 180° relative to one another and axially in a delivery region 16 of the developer mix which respectively cover a plurality of turns 18 of the first mixing screw. The mixing trough 14 also comprises oblique slots 19 arranged along the first mixing screw. The mixing trough 14 has a trough height 21 decreasing in conveying direction of a developer mix 20, the function thereof to be set forth later.

A second mixing screw 22 which is likewise provided with windings is situated within the mixing chamber 12 and below the first mixing screw, being situated in the supply region 13 of the developing station. The second mixing screw 22 is covered relative to the developing drum (magnetic drum) via a protective plate 23. An elongated scraper strip 24 comprising an actual scraping region 25 and a region which is fashioned in the form of a scraper cone having individual scraping teeth 26 is situated above the two mixing screws. A baffle 27 is arranged as a guide means on the scraping region 25 of the scraping strip 24 arranged in the proximity of the delivery region 16.

A metering baffle 28 extending over the region of the scraping teeth 27 is located at an angle relative to the scraper strip 24, this metering baffle 28 extending through the scraping teeth 26 of the scraper strip 24 and thereby leaving through openings 29 open above the teeth 26. The metering baffle 28 includes baffles 30 at its lower part. The metering baffle 28 is thereby fashioned of one piece with the baffles 30, whereby the baffles have the form of cross paddles.

When the developing station is running, toner mix is supplied to the toner feed region 16 of the mixing trough 14 with the assistance of the scraper strip 24, namely via the scraping region 25 and the baffle 27. The fast mixing-in of the replenished toner ensues here by means of the mixing strips 17 offset by 180° and displaced in axial direction of the first mixing screw 15. Due to the mixing strips 17, the conveying speed of the developer mix is considerably reduced in the mixing trough 14 and, further, what is referred to as a buoyance of the toner is prevented. An adequate mixing-in of toner, namely both of fresh toner as well as toner from the developing station, can thus ensue within a short mixing path. As a result of the short mixing path, it is possible to uniformly offer the developer enriched with supplied toner to the developing process over nearly the full width of the developing station. This is enabled by the metered passage of the enriched developer 20 into the supply region 13 of the developing station 10 via the defined oblique slots 19 in the mixing trough 14. Oblique slots 19 having the dimensions of $25 \times 1.1$ mm, an angle of inclination of 45° and a division of 10 mm have proven favorable. A defined geometry and position of the mixing trough 14 and of the oblique slots 19 is of significance for functional reasons. A passage of toner lumps which have not yet been mixed in, namely a passage thereof into the supply region 13, is thus prevented by the defined width of the oblique slots 19.

As a result of the trough height of the mixing trough 14 which decreases in conveying direction of the mixture 20, developer mix 20 can pass over the edge of the mixing trough 14 into the supply region 13 in a defined fashion beginning with a specific filling degree. An additional mix leveling given different filling levels is thus achieved. Via a notch or recess 31 in the mixing trough, further, developer can pass into the region of the mixing screw 15 in the region of the mixing trough 14 beginning with a defined filling level of mixture in the supply region 13, whereby a back-up of mix in the supply region 13 is avoided. A constant mix level both in the mixing trough 14 as well as in the supply region 13 is necessary for a uniform inking over the print-span.

In order to keep the mix level in the mixing trough 14 constant, roughly that quantity of developer that passes through the oblique slots 19 of the mixing trough 14 into the supply region 13 is added to the mixing trough 14, being added through the scraper teeth 26 of the scraper strip 24 in combination with the trough openings of the metering baffle 28.

The baffles 27 at the lower region of the metering baffle 28 which have the shape of crossed paddles have the job of lending that part of the developer situated on the developing drum which is not scraped off a defined flow direction in the supply region 13. During the blending process, the two mixing screws move in opposite rotational directions (arrow direction). The flow directions of the developer mix occurring due to the mixing process are shown in the drawings as arrows referenced EF (developer flow).

As is apparent from the foregoing specification, the invention is susceptible of being embodied with various alterations and modifications which may differ particularly from those that have been described in the preceding specification and description. It should be understood that I wish to embody within the scope of the patent warranted hereon all such modifications as reasonably and properly come within the scope of my contribution to the art.

I claim as my invention:

1. In a mixing device for blending a developer composed of carrier particles and toner for developing charge images applied to a charge image carrier in a developing station including a first mixing screw in a mixing chamber arranged parallel to a developing drum, said first mixing screw moving the developer from a delivery region parallel to said developing drum in a mixing through while blending it, a second mixing screw arranged below said first mixing screw for returning said developer along said developing drum, whereby said developing drum constantly conveys a part of said developer from said developing drum to said charge image carrier, and wherein a scraper strip arranged above said mixing screw picks up developer adhering to said developing drum and supplies it at least partially to said first mixing screw via a guide means, the improvement comprising wherein at least in the delivery region, said mixing trough of said first mixing screw includes axially extending mixing strips located at the circumference of the mixing screw extending over a plurality of spirals of said mixing screw for fast blending of the supplied developer and said mixing trough includes a plurality of openings via which said developer is supplied to said second mixing screw essentially over the full width of said mixing screw.

2. A mixing device according to claim 1, wherein said mixing strips are arranged offset by 180° radially and in axial direction relative to one another.

3. In a mixing device for blending a developer composed of carrier particles and toner for developing images applied to a charge image carrier in a developing station including a first mixing screw in a mixing chamber arranged parallel to a developing drum, said first mixing screw moving the developer from a delivery region parallel to said developing drum in a mixing trough while blending it, a second mixing screw arranged below said first mixing screw for returning said developer along said developing drum, whereby said developing drum constantly conveys a part of said developer from said developing drum to said charge image carrier, and wherein a scraper strip arranged above said mixing screw picks up developer adhering to said developing drum and supplies it at least partially to said first mixing screw via a guide means, the improvement comprising wherein at least in the delivery region, said mixing trough has a trough height decreasing in a conveying direction of said developer, so that developer passes over the edge of said mixing trough into said mixing chamber beginning with a prescribed filling degree, and includes mixing strips located at the circumference of the mixing screw extending over a plurality of spirals of said mixing screw for fast blending of the supplied developer and said mixing trough includes a plurality of openings via which said developer is supplied to said second mixing screw essentially over the full width of said mixing screw.

4. A mixing device according to claim 1, wherein said scraper strip is at least partially fashioned in the form of a scraper comb including a scraping teeth with clearances between said teeth.

5. A mixing device according to claim 4, wherein a metering baffle extending over said scraping teeth is arranged at an angle relative to said scraper strip, said metering baffle supplying the developer stripped off by said scraping teeth to said mixing trough via the tooth clearances or via through openings of said scraper strip.

6. A mixing device according to claim 5, wherein baffles are arranged below said scraper strip.

7. A mixing device according to claim 6, wherein said metering baffle extends through said scraping teeth and said baffles arranged below said scraper strip are fashioned in the form of crossed paddles.

8. A mixing device according to claim 1, wherein said openings of said mixing trough are formed as oblique slots.

9. A mixing device according to claim 8, wherein for a given fixed speed of said mixing screw and said developer drum, said scraper strip and said metering baffle are dimensioned such that the quantity of developer thereby supplied to said mixing trough roughly corresponds to the quantity of developer emerging through said oblique slots of said mixing trough.

* * * * *